US007651409B1

(12) United States Patent
Mier

(10) Patent No.: US 7,651,409 B1
(45) Date of Patent: Jan. 26, 2010

(54) GOLF CLUB PUTTER

(76) Inventor: Kelly J. Mier, 596 Smithridge Park, Reno, NV (US) 89502-5781

( * ) Notice: Subject to any disclaimer, the term of this patent is extended or adjusted under 35 U.S.C. 154(b) by 35 days.

(21) Appl. No.: 11/844,630

(22) Filed: Aug. 24, 2007

(51) Int. Cl.
*A63B 53/04* (2006.01)

(52) U.S. Cl. ..... 473/330; 473/340

(58) Field of Classification Search ..... 473/324–325, 473/330, 340–341
See application file for complete search history.

(56) References Cited

U.S. PATENT DOCUMENTS

| | | | | |
|---|---|---|---|---|
| 3,042,405 | A | 7/1962 | Solheim | |
| 3,954,265 | A * | 5/1976 | Taylor | 473/252 |
| D245,932 | S | 9/1977 | Lowry | |
| D324,896 | S * | 3/1992 | Froiland et al. | D21/743 |
| 5,211,401 | A * | 5/1993 | Hainey | 473/340 |
| 5,382,019 | A * | 1/1995 | Sneed | 473/304 |
| 5,759,114 | A * | 6/1998 | Bluto et al. | 473/340 |
| 5,857,922 | A * | 1/1999 | Delio | 473/313 |
| 6,099,413 | A * | 8/2000 | Naylor | 473/226 |
| D443,664 | S | 6/2001 | Olson | |
| 6,520,865 | B1 * | 2/2003 | Fioretti | 473/251 |
| 6,695,708 | B2 | 2/2004 | Fisher | |
| 6,988,959 | B2 | 1/2006 | Pollman | |
| 7,033,283 | B2 * | 4/2006 | Kang | 473/231 |
| 7,040,999 | B2 | 5/2006 | Trainello | |
| 7,347,793 | B2 * | 3/2008 | Davis | 473/305 |
| 7,399,233 | B2 * | 7/2008 | Pollman | 473/251 |
| 2002/0072430 | A1 | 6/2002 | Bullock | |
| 2005/0221908 | A1 * | 10/2005 | Gornall | 473/285 |
| 2005/0282656 | A1 * | 12/2005 | Davis | 473/340 |
| 2008/0248893 | A1 * | 10/2008 | Davis | 473/313 |

* cited by examiner

*Primary Examiner*—Stephen L. Blau

(57) ABSTRACT

This patent discloses a golf club putter to improve a golf putt swing through feedback. The golf club putter may include a shaft, a shaft insert attached to the shaft, and a head attached to the shaft insert. The head may have a body attached to the shaft insert, a shell having a clubface that may be configured to impact a golf ball, and shell fasteners that may be connected between the body and the shell to permit the shell to rotate relative to the body from an initial position. The shell may return to the initial position automatically.

11 Claims, 12 Drawing Sheets

GOLF CLUB PUTTER

BACKGROUND

1. Field

The information disclosed in this patent relates to a golf club putter that may be utilized to practice golf putt swings to improve a golf putt swing through feedback.

2. Background Information

Golf is a sport where a player strikes a ball by a stroke to advance the ball from a ball striking location to one of several numbered putting holes. The player plays a number of the putting holes sequentially with an object, on each hole, of advancing the ball from the ball striking location into the putting hole in the fewest number of strokes. The sport includes a playing area called a course that may vary from one course to the next and includes playing equipment directly used by the player or located on the playing area.

In addition to a golf bag, golf balls, and golf tees, a player usually carries several golf clubs during the game. It is the golf club that is swung by the player to strike the ball in playing the game. Each golf club is identified as a wood, iron, or putter according to its ball-striking portion. In the case of a putter, the ball-striking portion includes a structure to strike the ball such that the ball should move along an intended path on a putting green surface and remain on the green surface throughout its entire travel into the putting hole.

Putting is one of the most difficult and unforgiving aspects of golf. Players spend a significant portion of their practice time in perfecting their putt swing to help themselves hole more putts. It is so important to the game of golf and yet so difficult that the golf community likes to say, "Even God has to practice his putting." What is needed is a golf practice putter to help a golfer putt more successfully and hole more putts.

SUMMARY

This patent discloses a golf club putter to improve a golf putt swing through feedback. The golf club putter may include a shaft, a shaft insert attached to the shaft, and a head attached to the shaft insert. The head may have a body attached to the shaft insert, a shell having a clubface that may be configured to impact a golf ball, and shell fasteners that may be connected between the body and the shell to permit the shell to rotate relative to the body from an initial position. The shell may return to the initial position automatically.

DETAILED DESCRIPTION

Figure 1:
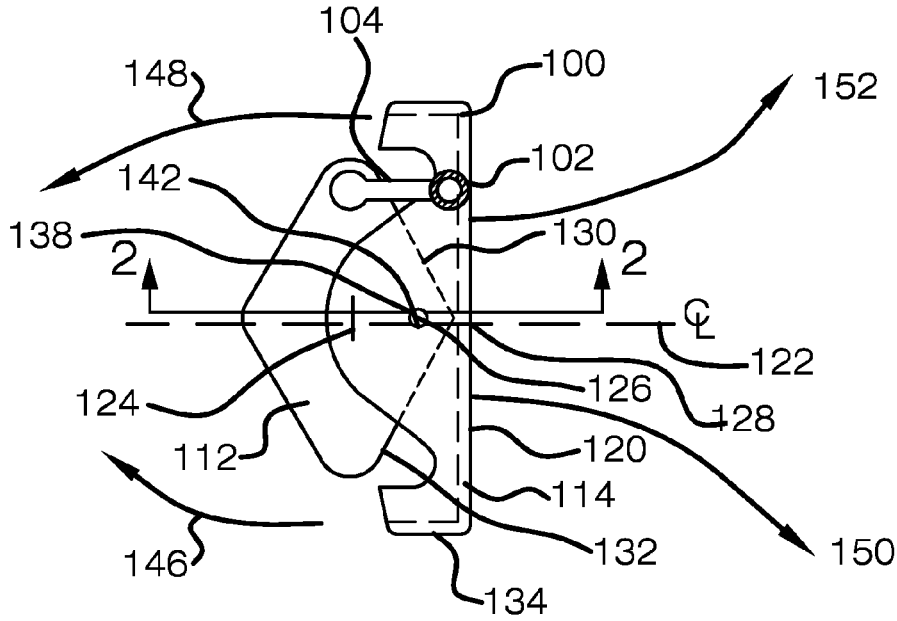
FIG. 1 is a top sectional view of a putter 100.
Figure 2:
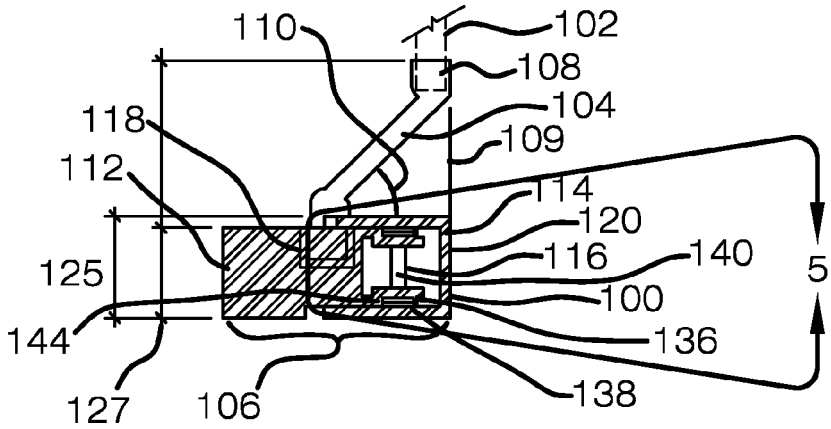
FIG. 2 is a side sectional view of putter 100 taken off line 2-2 of FIG. 1.
Figure 3:
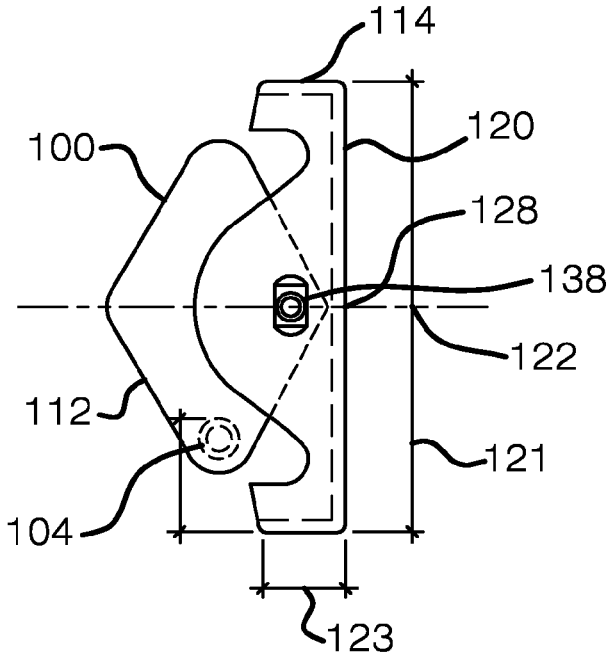
FIG. 3 is bottom sectional view of putter 100.

FIG. 1 is a top sectional view of a putter 100. FIG. 2 is a side sectional view of putter 100 taken off line 2-2 of FIG. 1. FIG. 3 is bottom sectional view of putter 100. Putter 100 may be a special golf club for striking a golf ball to make the golf ball roll with little to no loft. Additionally, putter 100 may be a club designed for use on the green of a golf course.

The generally are three major tendencies in an average to below average putting stroke of a golfer. A first tendency is for the golfer to arc the putter around the body of the golfer. A second tendency involves at least one of hitting the golf ball off the center of the putter clubface and turning the putter clubface. Third, many players tend to either pull with their weak hand or push with their strong hand, which may move the stroke path off parallel with the shoulder line of the golfer.

Putter 100 may include mechanics that may exaggerate a ball roll in an offset direction if the ball is hit off-center of the putter clubface. Exaggerating the ball roll in an offset direction may help highlight to the golfer the particular mistake the golfer made in his/her stroke. This may be thought of as negative reinforcement. Putter 100 may include mechanics that may cause the ball to roll in a straight-line direction if the ball is hit by the center of the putter clubface with a straight stroke line. This may be thought of as positive reinforcement. In short, putter 100 may assist a golfer correct the two major tendencies in an average to below average putting stroke of a golfer through negative reinforcement and positive reinforcement.

The resulting feedback received by a golfer from using putter 100 may permit the golfer to make quick, on-the-spot adjustments to his/her putting stroke. With enough practice with putter 100, a golfer may develop a stroke that may travel straight trough the ball off the center of the putter clubface, along an unwavering straight (not arced) stroke path. This may result in the golfer being more confident and competent on the putting green and hole more putts.

As noted above, putter 100 may include mechanics that may exaggerate a ball roll in an offset direction if the ball is hit off-center of the putter clubface. In the below examples, the mechanics may cause the clubface of the golf club head to rotate relative to the golf club shaft should a golf ball strike the clubface off the center of the clubface.

Putter 100 may include a shaft 102, a shaft insert 104, and a head 106 (FIG. 2). Shaft 102 may be a hollow tube attached to a handgrip (not shown) at one end and shaft insert 104 at a shaft end 108. Shaft 102 may include steel, graphite, aluminum, titanium, wood, and a combination thereof.

Shaft insert 104 may connect shaft 102 to head 106 in a way that may align a side of shaft insert 104 with a clubface 120 of head 106 at a shaft plane 109 (FIG. 2) when clubface 120 is in an initial position 134. In one example, shaft insert 104 may include a shaft insert angle 110 that may bend shaft insert 104 from head 106 towards clubface 120. In one example, shaft insert angle 110 approximately may be forty-five degrees.

Head 106 may be that part of putter 100 used to strike a golf ball. As a most massive part of putter 100, head 106 may be attached to shaft insert 104. Head 106 may include stainless steel, graphite, titanium, beryllium, copper, persimmon wood, and a combination thereof.

Head 106 may include a body 112, a shell 114, and shell fasteners 116. Body 112 may be a weighted portion of head 106 having a hosel 118 to receive shaft insert 104 and fix body 112 in place relative to shaft 102 such that body 112 does not rotate relative to shaft 102. Hosel 118 may include features to support an entry point for shaft insert 104 into head 106 of putter 100 and to act as a buffer between shaft insert 104 and club head 108 that may provide a secure fit between the two to minimize vibration.

Shell 114 may include clubface 120 that may be configured to impact a golf ball. Shell 114 may be moveably fixed to body 112 by shell fasteners 116. A centerline 122 may pass through a body center 124 of body 112 and a shell fastener center 126 of shell fasteners 116. Body center 124 of body 112 may be at least one of a mass center and a shape center of body 112. In one example, body 112 may be diamond shape having body center 124 as a mass center and a perimeter center of body 112. When clubface 120 is in initial position 134, centerline 122 may pass through a clubface center 128 of clubface 120 as well as body center 124.

Shell 114 may have a shell length 121 (FIG. 3), a shell width 123, and a shell height 125 (FIG. 2). In one example, shell length 121 approximately may be 4½ inches, shell width 123 approximately may be ¾ inches, and shell height 125 approximately may be one inch. Head 106 may have a head height 127 (FIG. 2) and in one example, head height 127 approximately may be ⅞-inch high.

Figure 4:
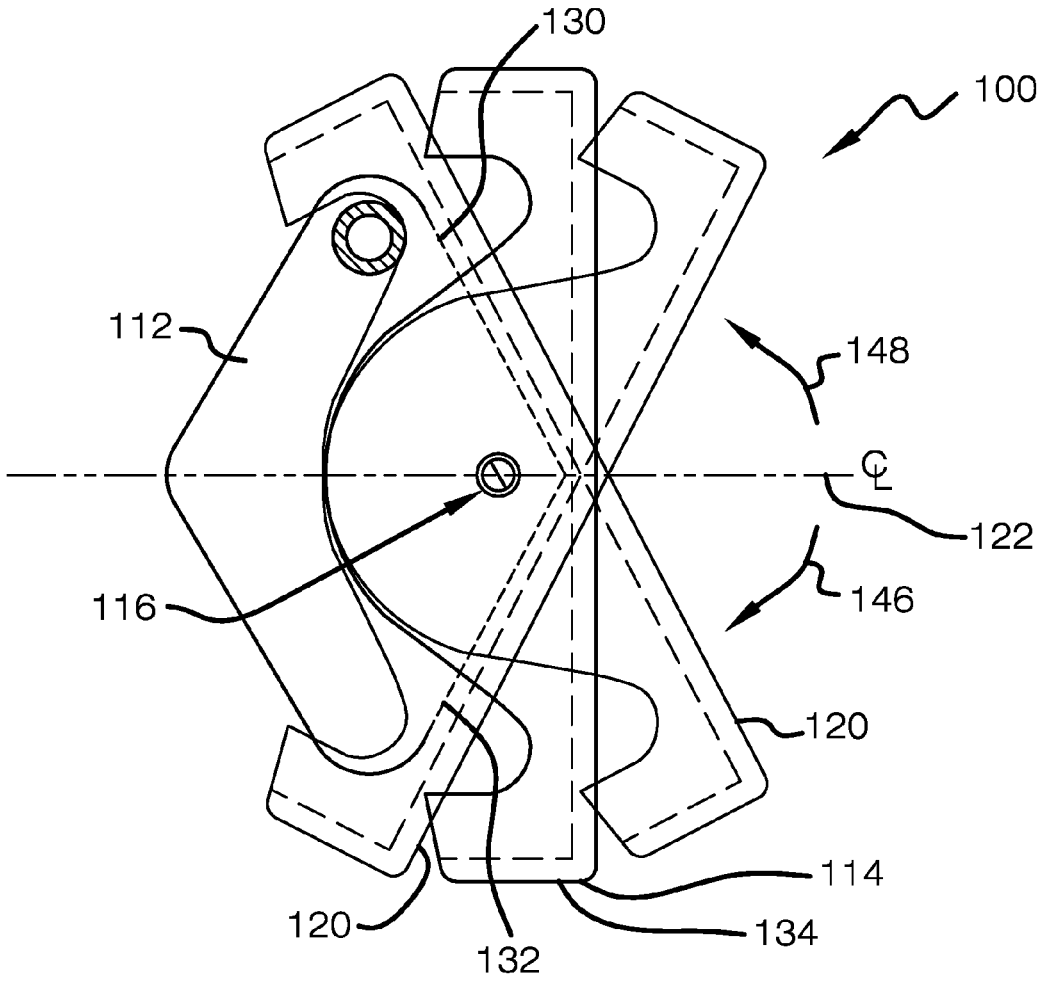
FIG. 4 is a top view of putter 100 with shell 114 in multiple positions.

FIG. 4 is a top view of putter 100 with shell 114 in multiple positions. Body 112 may be shaped to permit clubface 120 to rotate a predetermined distance about shell fasteners 116. For example, body 112 may include a first angled face 130 and a second angled face 132 that may be angled relative to first angled face 130 about centerline 122. Clubface 120 may rotate clockwise and counter-clockwise about shell fasteners 116 until contacting either first angled face 130 or second angled face 132. In one example, clubface 120 may be configured approximately to rotate over a twenty-seven degree angle from first angled face 130 to an initial position 134 and approximately over a twenty-seven degree angle from initial position 134 to second angled face 132. In another example, clubface 120 may be configured to rotate approximately over a fifty-four degree angle from first angled face 130 to second angled face 132.

As in FIG. 2, shell 114 may be attached to body 112 with shell fasteners 116. To aid in this, body 112 may include body through-holes 136 (FIG. 2) and shell 114 may include shell through-holes 138, each located on centerline 122. In this example, shell fasteners 116 may include a hollow pin 140 configured to receive a screw 142.

Hollow pin 140 may be a machined stainless steel threaded hollow pin. Screw 142 may be a machined stainless steel screw having a length that may be less than a length of hollow pin 140. With hollow pin 140 passed from a bottom of shell 114 through two body through-holes 136 and one shell through-holes 138, screw 142 may be passed from a top of shell 114 through one shell through-hole 138 and screwed into hollow pin to attach shell 114 to body 112. A friction insert 144 may be positioned beneath a surface of shell 114 and around hollow pin 140. Friction insert 144 may be made of a fluorinated polymer, such as polytetrafluoroethylene, to reduce pivot friction between shell 114 and body 112.

If clubface center 128 hits a golf ball and the golf stroke is a straight-line stroke, then the golf ball may roll straight ahead. If clubface 120 hits a golf ball at a location other than clubface center 128, clubface 120 may rotate about hollow pin 140 in a direction of arrow 146 or arrow 148 and may exaggerate a ball roll in offset direction 150 or offset direction 152, respectively.

FIG. 1 illustrates shell 114 in initial position 134. In initial position 134, centerline 122 may pass through clubface center 128. After a use of putter 100, centerline 122 may no longer pass through clubface center 128 and shell 100 may need to be rotated back to the initial position so that putter 100 may be used again to assist a golfer in correcting their stroke tendency. It may be desirable to have shell 100 automatically rotate back to the initial position.

Figure 5:
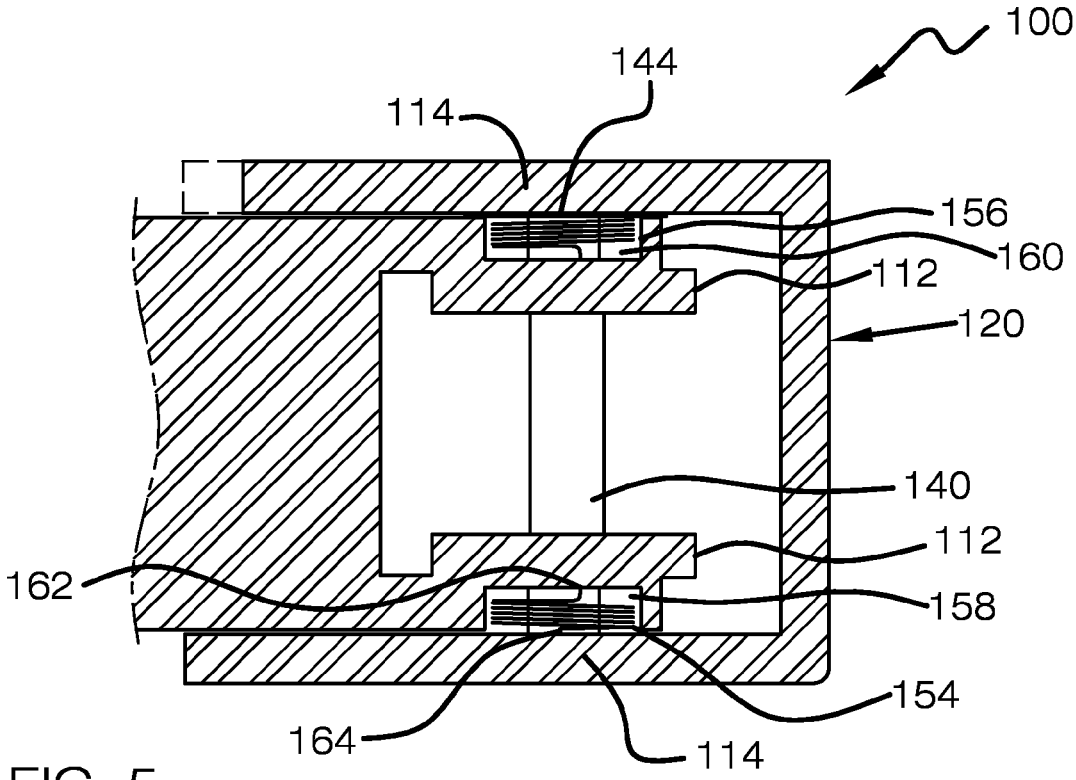
FIG. 5 is an enlarged view of putter 100 generally taken off line 5 of FIG. 2.

FIG. 5 is an enlarged view of putter 100 generally taken off line 5 of FIG. 2. Putter 100 additionally may include a first spring 154 and a second spring 156. Each spring may be a torsion spring and may be calibrated and positioned to bring clubface 120 to initial position 134. Both first spring 154 and second spring 156 may be positioned about hollow pin 140 and positioned between shell 114 and body 112, such as in a first cavity 158 and a second cavity 160 within body 112. Each spring may include tails to secure the spring in place. For example, first spring 154 (FIG. 5) may include a first spring tail 162 configured to be accepted by a small hole within body 112 and a second spring tail 164 configured to be accepted by a small hole within shell 100. Wall surfaces may be drilled in a center to form small holes that may accept torsion spring tails 162, 164. As shell 100 is rotated relative to body 112, first spring 154 and second spring 156 may wind due to each end of each spring being fixed to one of body 112 and shell 100. First spring 154 and second spring 156 then may unwind due to spring force and urge shell 100 back into initial position 134.

Figure 6:
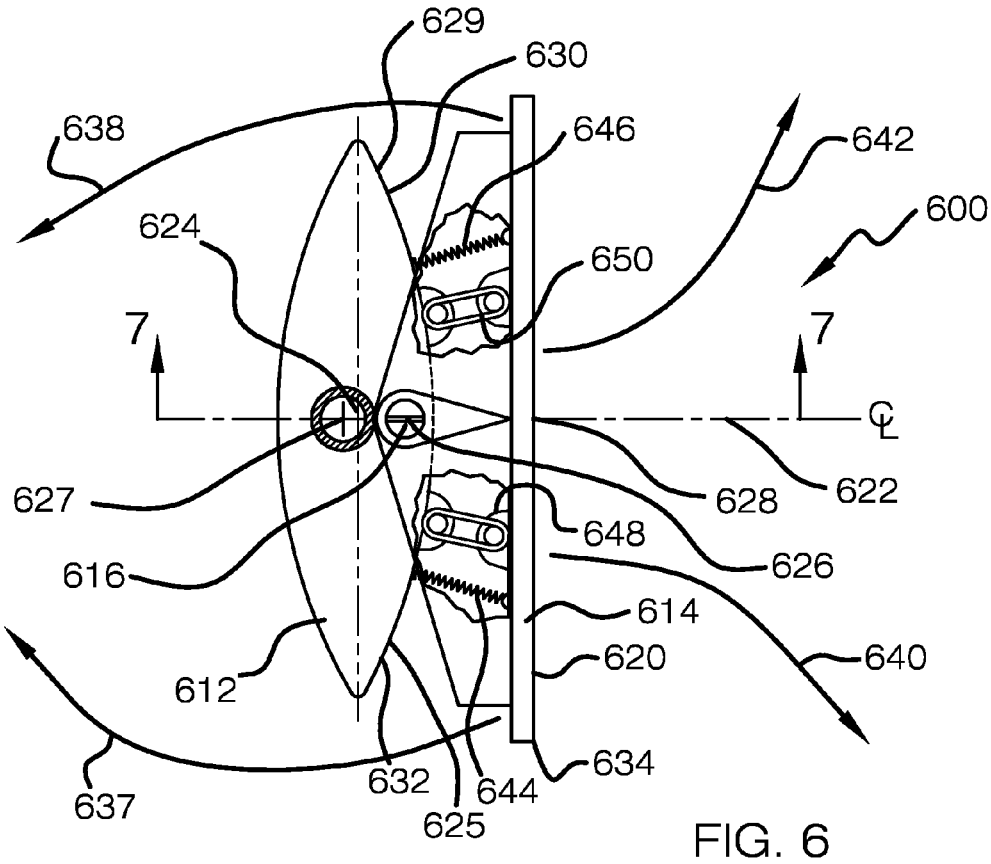
FIG. 6 is a top sectional view of a putter 600 with a shaft insert integral with a body.
Figure 7:
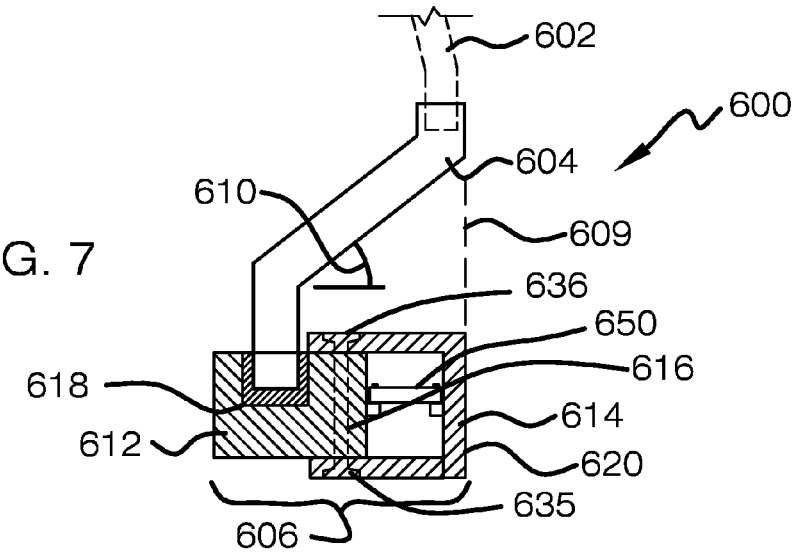
FIG. 7 is a side sectional view of putter 600 taken off line 7-7 of FIG. 6.

FIG. 6 is a top sectional view of a putter 600 with a shaft insert integral with a body. FIG. 7 is a side sectional view of putter 600 taken off line 7-7 of FIG. 6. Putter 600 may be a special golf club for striking a golf ball to make the golf ball roll with little to no loft. Putter 600 may be a club designed for use on the green of a golf course. Putter 600 may include features similar to those features for putter 100.

Putter 600 may include a shaft 602, a shaft insert 604, and a head 606 (FIG. 7). Shaft insert 604 may connect shaft 602 to head 606 in a way that may align a side of shaft insert 604 with a clubface 620 of head 606 at a shaft plane 609 (FIG. 7) when clubface 620 is in an initial position 634 such as illustrated in FIG. 6 and FIG. 7. In one example, shaft insert 604 may include a shaft insert angle 610 that may bend shaft insert 604 from head 606 towards clubface 620. In one example, shaft insert angle 610 approximately may be forty-five degrees.

Head 606 may be that part of putter 600 used to strike a golf ball. As a most massive part of putter 600, head 606 may be attached to shaft insert 604. Head 606 may include a body 612, a shell 614, and shell fasteners 616. Body 612 may be a weighted portion of head 606 having a hosel 618 to receive shaft insert 604 and fix body 612 in place relative to shaft 602 such that body 612 does not rotate relative to shaft 602. Hosel 618 may include features to support an entry point for shaft insert 604 into head 606 of putter 600 and to act as a buffer between shaft insert 604 and club head 608 that may provide a secure fit between the two to minimize vibration.

Shell 614 may include clubface 620 that may be configured to impact a golf ball. Shell 614 may be moveably fixed to body 612 by shell fasteners 616. A centerline 622 may pass through a body center 624 of body 612, a shell fastener center 626 of shell fasteners 616, and a hosel center 627 of hosel 168. Body center 624 of body 612 may be at least one of a mass center and a shape center of body 612. In one example, body 612 may have body center 624 as a mass center and a perimeter center of body 612. When clubface 620 is in initial position 634, centerline 622 may pass through a clubface center 628, body center 624, and hosel center 627. In one example, hosel center 627 may be offset from body center 624 so that body center 624 may reside between hosel center 627 and clubface center 628.

Body 612 may be shaped to permit clubface 620 to rotate a predetermined distance about shell fasteners 616. For example, body 612 may include a first curved face 630 and a second curved face 632 that may be curved relative to first curved face 630 about centerline 622. Clubface 620 may rotate clockwise and counter-clockwise about shell fasteners 616 until contacting either first curved face 630 or second curved face 632. In one example, clubface 620 may be configured approximately to rotate over a twenty to forty degree angle from first curved face 630 to an initial position 634 and approximately over a twenty to forty degree angle from initial position 634 to second curved face 632. In another example, clubface 620 may be configured to rotate approximately over a forty to fifty degree angle from first curved face 630 to second curved face 632.

As in FIG. 7, shell 614 may be attached to body 612 with shell fasteners 616. Shell fasteners 616 may include a hollow pin 635 configured to receive a screw 636. Hollow pin 635 may be a machined stainless steel threaded hollow pin. Screw 636 may be a machined stainless steel screw having a length that may be less than a length of hollow pin 635.

If clubface center 628 hits a golf ball and the golf stroke is a straight line stroke, then the golf ball may roll straight ahead. If clubface 620 hits a golf ball at a location other than clubface center 628, clubface 620 may rotate about hollow pin 635 in a direction of arrow 637 or arrow 638 and may exaggerate a ball roll in an offset direction 640 or offset direction 642, respectively.

FIG. 6 illustrates shell 614 in initial position 634. In initial position 634, centerline 622 may pass through clubface center 628. After a use of putter 600, centerline 622 may no longer pass through clubface center 628 and shell 600 may need to be rotated back to the initial position so that putter 600 may be used again to assist a golfer in correcting their stroke tendency. It may be desirable to have shell 600 automatically rotate back to the initial position.

Putter 600 additionally may include a first tension spring 644 and a second tension spring 646. First tension spring 644 may be connected between a first rounded face 625 of head 612 and clubface 616. Second tension spring 646 may be connected between second rounded face 629 and clubface 616. As shell 614 is rotated from initial position 634 shown in FIG. 6, first tension spring 644 and second tension spring 646 may urge shell 614 back into the initial position with a combination of tension and compression spring force.

Alternatively or in addition to first tension spring 644 and second tension spring 646, putter 600 may include a first rubber band 648 and a second rubber band 650. First rubber band 648 may be connected between a first rounded face 625 of head 612 and clubface 616 and second rubber band 650 may be connected between second rounded face 629 and clubface 616. As shell 614 is rotated from the initial position shown in FIG. 6, one of first rubber band 648 and second rubber band 650 may urge shell 614 back into the initial position through a tension force.

Utilizing first tension spring 644 and second tension spring 646 to center shell 614 permits quick replacement of these springs in comparison to first spring 114 and second spring 156. In addition, first tension spring 644 and second tension spring 646 may be calibrated to hold less tension while retaining more consistent strength of material than rubber bands. Utilizing first rubber band 648 and second rubber band 650 to center shell 614 permits quick replacement of the rubber bands in case of damage or rupturing of the rubber bands. However, the rubber bands may stretch unevenly, which may cause shell 614 to return to a position other than the initial position.

Figure 8:
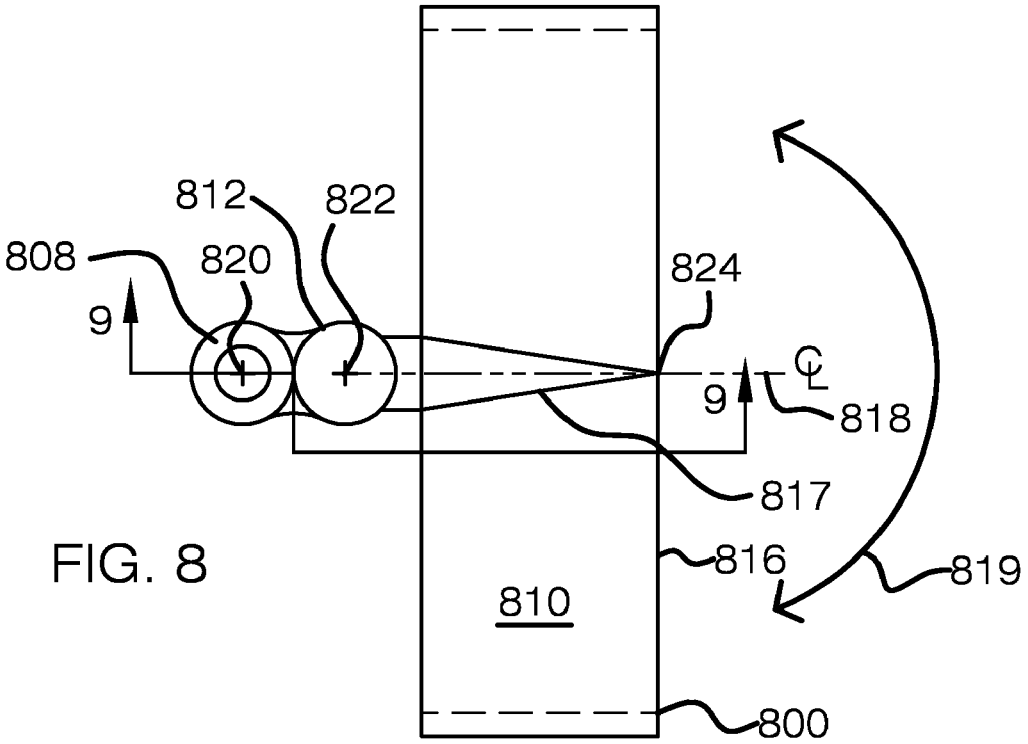
FIG. 8 is a top sectional view of a putter 800 with a shaft insert integral with a body.
Figure 9:
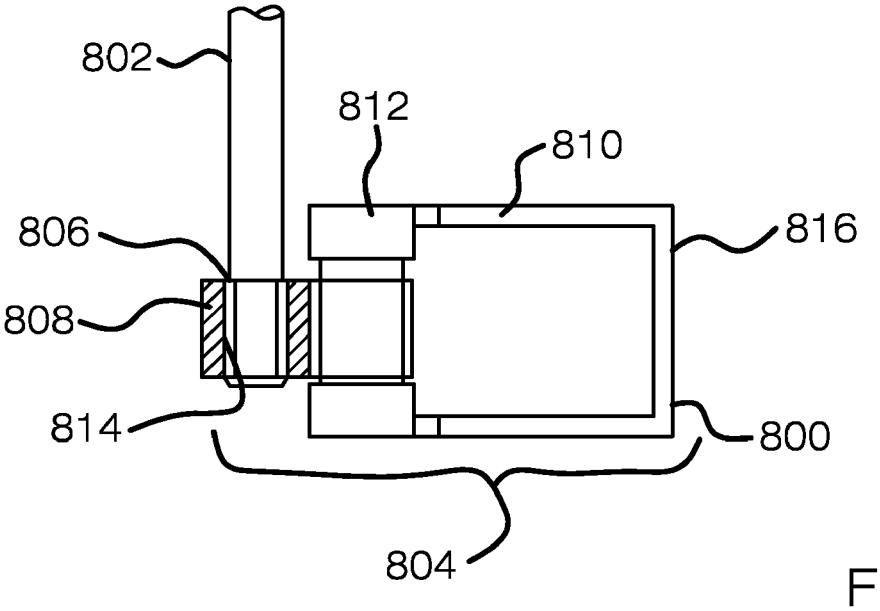
FIG. 9 is a side sectional view of putter 800 taken off line 9-9 of FIG. 8.

FIG. 8 is a top sectional view of a putter 800 with a shaft insert integral with a body. FIG. 9 is a side sectional view of putter 800 taken off line 9-9 of FIG. 8. Putter 800 may be a special golf club for striking a golf ball to make the golf ball roll with little to no loft. Putter 800 may be a club designed for use on the green of a golf course. Putter 800 may include features similar to those features for putter 100. In this example, a device may utilize gravity to center the shell. It may be an isometric putter-centering device.

Putter 800 may include a shaft 802 attached to a head 804 (FIG. 9) at shaft end 806. Head 804 may include a body 808, a shell 810, and shell fasteners 812. Body 808 may be a weighted portion of head 808 having a hosel 814 to receive shaft end 806 and fix body 808 in place relative to shaft 802 such that body 808 does not rotate relative to shaft 802. Body 808 may be a shaft carriage. Hosel 814 may be integral with body 808 as in FIG. 8 or separate from body 808 as in FIG. 7.

Shell 810 may include a clubface 816 that may be configured to impact a golf ball and a centering arrow 817. Centering arrow 817 may be painted or inlaid in shell 810. Shell 810 may be moveably fixed to body 808 by shell fasteners 812 and may rotate in a direction of an arrow 819. A centerline 818 may pass through a shaft center 820 of shaft 802 and a shell fastener center 822 of shell fasteners 812. Moreover, clubface 816 may be positioned such that centerline 818 may pass through a clubface center 824 of clubface 816.

Shell 810 may be attached to body 808 with shell fasteners 812. Shell fasteners 812 may be a gravity centering mechanism. In general, an impact of clubface 816 with a golf ball may cause a pin in shell fasteners 812 to roll up a curved groove and gravity then may act on a weight of shell fasteners 812 to cause the pin to roll down that same curved groove to center clubface 816.

Figure 10:
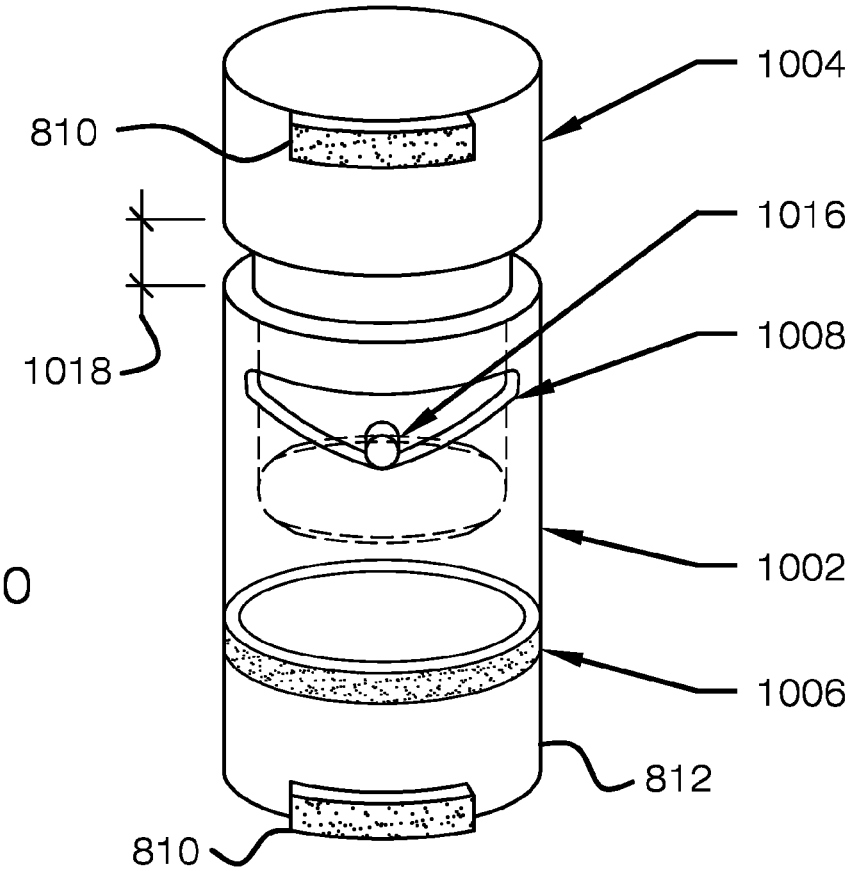
FIG. 10 is an isometric view of shell fasteners 812.

FIG. 10 is an isometric view of shell fasteners 812. Shell fasteners 812 may include a sleeve 1002, a core 1004, and a bearing 1006, each of which generally may have a cylinder shape. Sleeve 1002 may be position around core 1004 and bearing 1006 may be positioned between sleeve 1002 and core 1004. Core 1004 may be attached to shell 810 and may rotate and move up and down relative to sleeve 1002.

Figure 11:
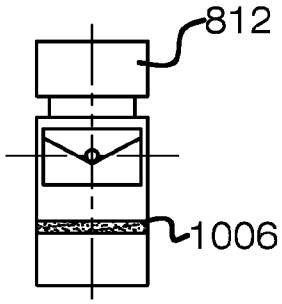
FIG. 11 is a side view of shell fasteners 812.
Figure 12:
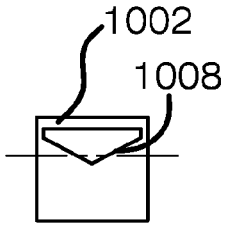
FIG. 12 is a front view of sleeve 1002.
Figure 13:
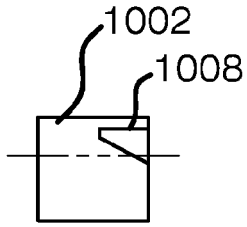
FIG. 13 is a side view of sleeve 1002.
Figure 14:
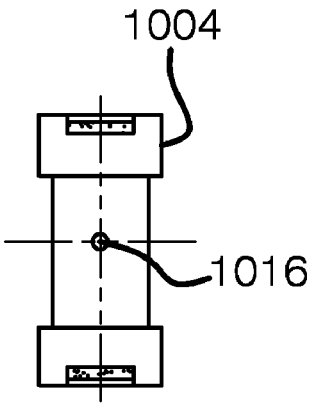
FIG. 14 is a front view of core 1004.
Figure 15:
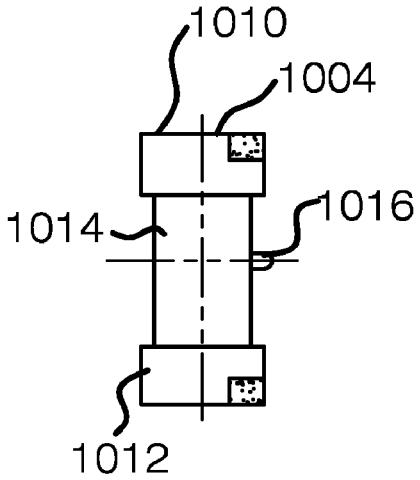
FIG. 15 is a side view of core 1004.

FIG. 11 is a side view of shell fasteners 812. FIG. 12 is a front view of sleeve 1002. FIG. 13 is a side view of sleeve 1002. FIG. 14 is a front view of core 1004. FIG. 15 is a side view of core 1004.

Shell fasteners 812 may include a sleeve 1002, a core 1004, and a bearing 1006. Sleeve 1002 may be positioned around core 1004 and bearing 1006 may be positioned between sleeve 1002 and core 1004. Core 1004 may be attached to shell 810 and may rotate and move up and down relative to sleeve 1002.

Sleeve 1002 may be a hollow tube having a centering track 1008. Centering track 1008 may be a triangular shape region cutout of sleeve 1002. In one example, a radian distance of centering track 1008 may be less than 180-degrees.

Core 1004 may include a first cap 1010 (FIG. 15) attached to a second cap 1012 by a core body 1014. A diameter of body 1014 may be less than a diameter of first cap 1010 and a diameter of second cap 1012. Core 1004 additionally may include a pin 1016 positioned on core body 1014 between first cap 1010 and second cap 1012. Pin 1016 may extend radially outward from core body 1014.

In assembly, bearing 1006 may reside between second cap 1012 and sleeve 1002. Pin 1016 may be positioned in centering track 1008. Without influence of forces other than gravity, pin 1016 may be positioned in an initial position between two angled sides of centering track 1008. As core 1004 turns relative to sleeve 1002, pin 1016 may ride up an angled side of centering track 1008. Core 1004 may move a height 1018 (FIG. 10) relative to sleeve 1002. In one example, height 1018 may equal a height of centering track 1008. In another example, height 1018 substantially may equal ⅛ inch.

When free from forces other than gravity, a weight of core 1004 may cause core 1004 to drop down relative to sleeve 1002. As core 1004 drops down, pin 1016 may follow centering track 1008 downward to cause core 1004 to rotate back to the initial position.

The centering device may be a gravity centering mechanism. The centering of the club face may rely on a pin that may turn with the club face and roll up a curved groove that may be cut into a sleeve (outer) piece of the mechanism. Unlike a spring and rubber band, the gravity centering mechanism may not need replacing or recalibrating.

Figure 16:
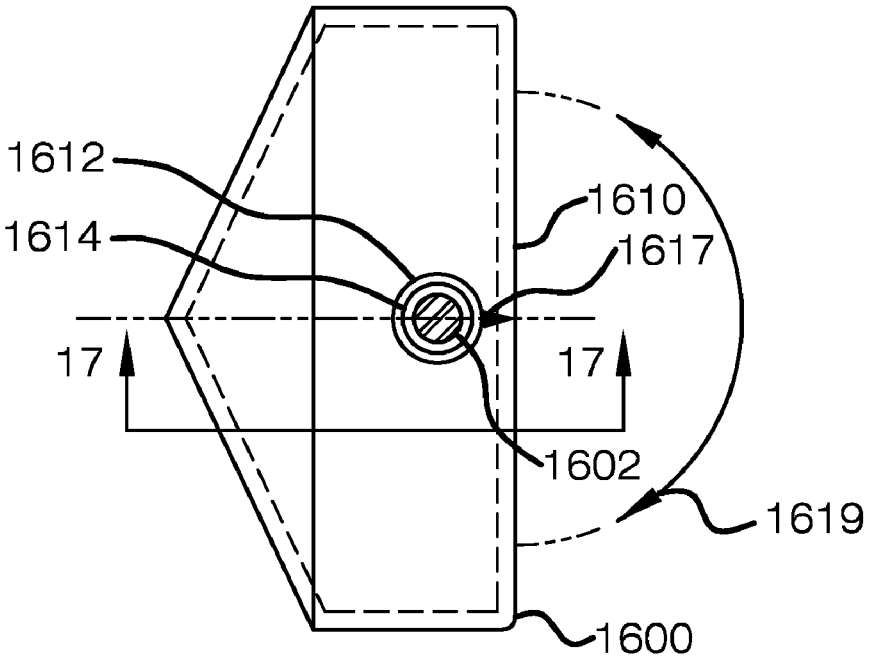
FIG. 16 is a top sectional view of a putter 1600 with a shaft insert integral with a body.
Figure 17:
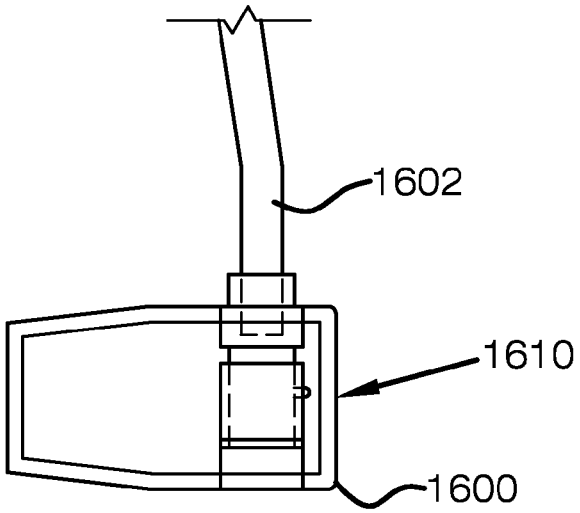
FIG. 17 is a side sectional view of putter 1600 taken off line 17-17 of FIG. 16.

FIG. 16 is a top sectional view of a putter 1600 with a shaft insert integral with a body. FIG. 17 is a side sectional view of putter 1600 taken off line 17-17 of FIG. 16. Putter 1600 may be a special golf club for striking a golf ball to make the golf ball roll with little to no loft. Putter 1600 may be similar to putter 800 with a similar isometric putter centering device 812, but a shaft 1602 may be attached above an isometric putter centering device 1612 rather than on a side as in putter 800. Putter 1600 may include a hosel 1614 as a flanged ferrule that may be integrated with a shell 1610. Shell 1610 may include a centering arrow 1617 that may be painted or inlaid. Shell 1610 may have a face and body of effective surface of club and may be configured to rotate about a pivot point in directions of arrow 1619.

Figure 18:
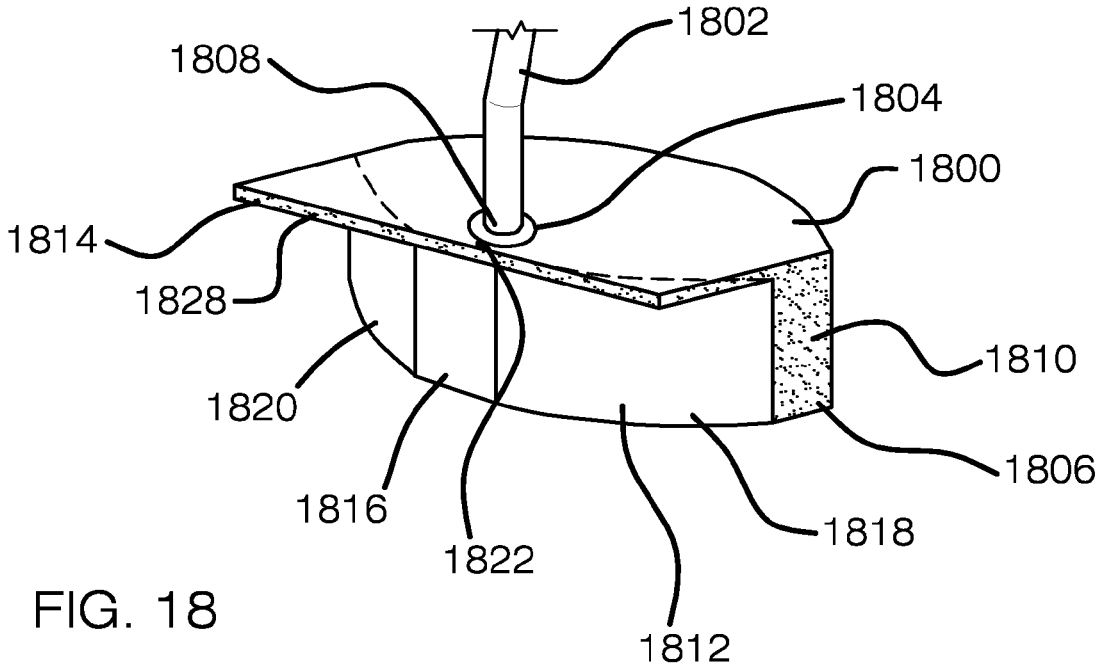
FIG. 18 is a top isometric view of a putter 1800.
Figure 19:
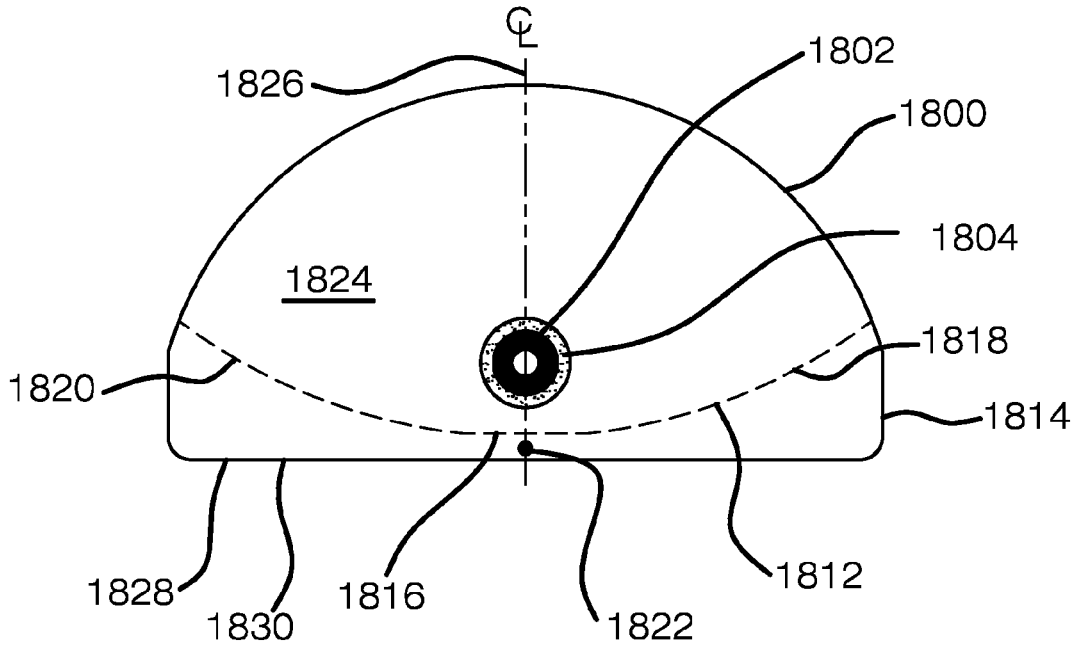
FIG. 19 is a top view of putter 1800.

FIG. 18 is a top isometric view of a putter 1800. FIG. 19 is a top view of putter 1800. In this embodiment, putter 1800 may provide exaggerated movement of a golf ball without moving parts. A false front may be position over a misshapen, practice clubface to hide the actual clubface visually from the golfer. Here, a golfer may use putter 1800 as though it were a properly formed, game clubface without being influenced by the visual appearance of the misshapen clubface. Thus, putter 1800 may work more closely to improve the put of a golfer when the use a properly formed, game clubface.

Putter 1800 may include a shaft 1802, a shaft insert 1804, and a head 1806 (FIG. 18). Shaft 1802 may be a hollow tube attached to a handgrip (not shown) at one end and shaft insert 1804 at a shaft end 1808. Shaft 1802 may include steel, graphite, aluminum, titanium, wood, and a combination thereof.

Shaft insert 1804 may connect shaft 1802 to head 1806. Head 1806 may be that part of putter 1800 used to strike a golf ball. As a most massive part of putter 1800, head 1806 may be attached to shaft insert 1804. Head 1806 may include stainless steel, graphite, titanium, beryllium, copper, persimmon wood, and a combination thereof. Head 1806 may include a shell 1810, a clubface 1812, and a false front 1814.

Shell 1810 may be a weighted portion of head 1806. Clubface 1812 may be an exposed portion of shell 1810 configured to impact a golf ball. Clubface 1812 may include a target 1816, a first off-target 1818, and a second off-target 1820. Target 1816 may be a flat, rectangular shaped surface orientated on clubface 1812 to be perpendicular to the stroke path of putter 1800 and move in the stroke path of putter 1800 during a proper swing of putter 1800.

A platinum point 1822 may be inlaid above target 1816 on a shell upper surface 1824 of shell 1810 to be visible to a user of putter 1800. Platinum point 1822 may provide a visual aid to a golfer to indicate the location of target 1816. Platinum point 1822 may be made of stainless steel, silver inlay, platinum colored paint, or other platinum colored material.

A profile of clubface 1812 may include a curve interrupted and made discontinuous by target 1816. First off-target 1818 and second off-target 1820 may be curved portions of clubface 1812 connected to each other by target 1816. If a first off-target 1818 or second off-target 1820 strike a golf ball, the effect may be to exaggerate the undesirable movement of the ball as a push shot or a pull shot. The exaggerated undesirable ball movement may inform the golfer as to problems with that golfer's putting stroke. If target 1816 strikes a golf ball, the golf ball may move along a desired path of ball role.

A centerline 1826 (FIG. 19) may pass perpendicularly through target 1816 to divide clubface 1812 in half so that first off-target 1818 and second off-target 1820 resides equidistance from centerline 1812 on opposite sides of centerline 1826.

False front 1814 may be a thickness of material that may extend shell upper surface 1824 so that it overhangs clubface 1812 when view from shell upper surface 1824. False front 1814 may include a lead false front edge 1828 having a lead false front edge profile 1830. Preferably, lead false front edge profile 1830 may provide a top view representation of a game putter clubface to a user of putter 1800 while concealing the practice clubface 1812 of putter 1800 from the user. In one example, lead false front edge profile 1830 may be straight and perpendicular to centerline 1826.

Figure 20:
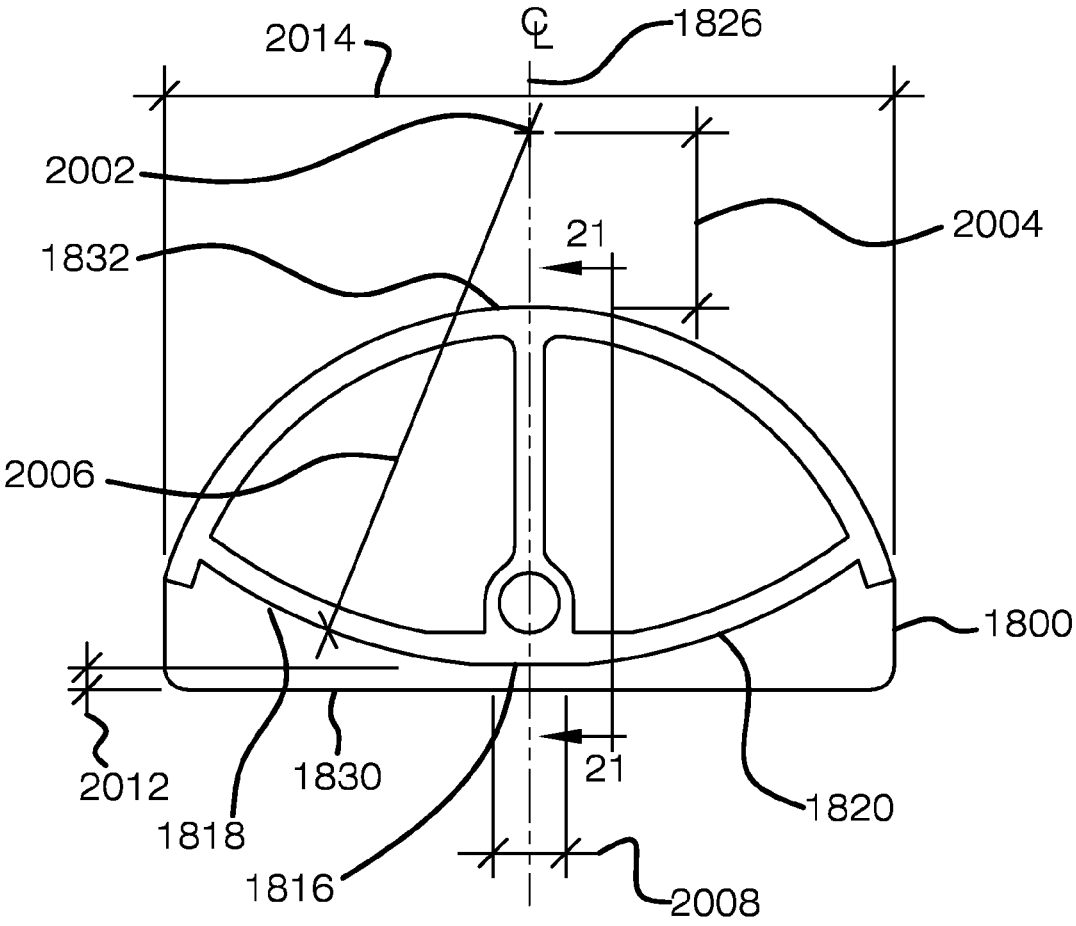
FIG. 20 is a bottom view of putter 1800.
Figure 21:
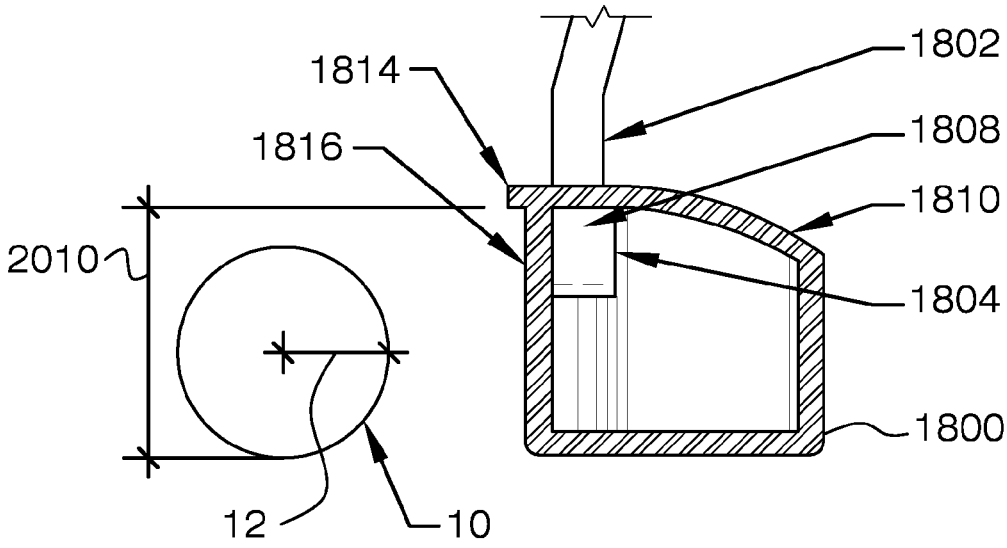
FIG. 21 is a side sectional view of putter 1800 generally taken off line 21-21 of FIG. 20.

FIG. 20 is a bottom view of putter 1800. FIG. 21 is a side sectional view of putter 1800 generally taken off line 21-21 of FIG. 20. In addition to clubface 1812, shell 1810 may include shell rear 1832, through which centerline 1826 may pass. The curvature of first off-target 1818 and second off-target 1820 may be part of a circle having a circle center 2002 on centerline 1826 that may be positioned at a shell rear distance 2004 away from shell rear 1832 along centerline 1826. The curvature of first off-target 1818 and second off-target 1820 may have an off-target radius 2006.

Target 1816 may have a target width 2008 and a target height 2010 (FIG. 21). Lead false front edge profile 1830 may be position at an overhang distance 2012 (FIG. 20) from target 1816 and false front 1814 may have a false front width 2014. A typical golf ball 10 (FIG. 21) may have a radius 12, such as 13/16 inches.

To provide a curvature to exaggerate off-target ball movement sufficiently, a ratio of off-target radius 2006 to shell rear distance 2004 approximately may be 3:1. In one example, off-target radius 2006 approximately may be 3 9/16 inches.

Target width 2008 should be wide enough to cause golf ball 10 to move along a desired path of ball roll. However, if target width 2008 is too wide, golf ball 10 may not move along a desired path of ball roll even of struck by target 1816. In addition, target height 2010 should be high enough to keep false front 1814 from interfering with golf ball 10. Accordingly, a ratio of target height 2010 to target width 2008 approximately may be 4:1. In one example, target width 2008 approximately may be ½ inch.

False front 1814 should hang over target 1816 a distance to convey a top view representation of a game putter clubface sufficiently without misrepresenting such a view. In one example, overhang distance 2012 may not be greater than ¼ inch and not less than 1/32 inch. In another example, overhang distance 2012 approximately may be 1/16 inch and false front width 2014 approximately may be 4¾ inches.

Figure 22:
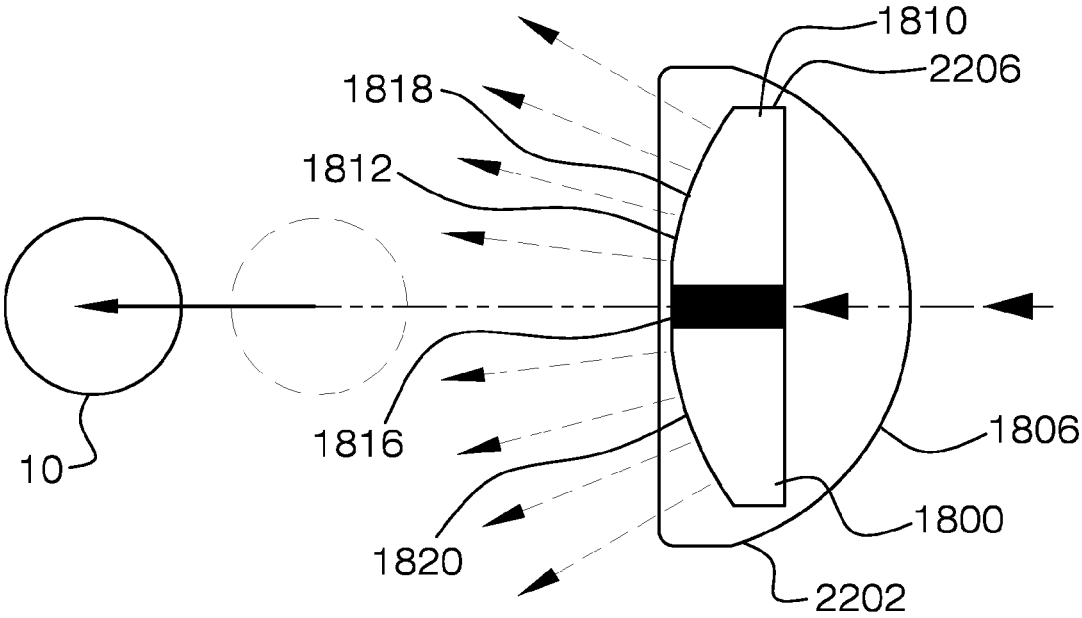
FIG. 22 is a schematic bottom view of putter 1800 in operation.

FIG. 22 is a schematic bottom view of putter 1800 in operation. In this example, putter 1800 may have a false front 2202 and head 1806 may have a head perimeter 2204. Here, false front 2202 may overhang the entire head perimeter 2204.

Figure 23:
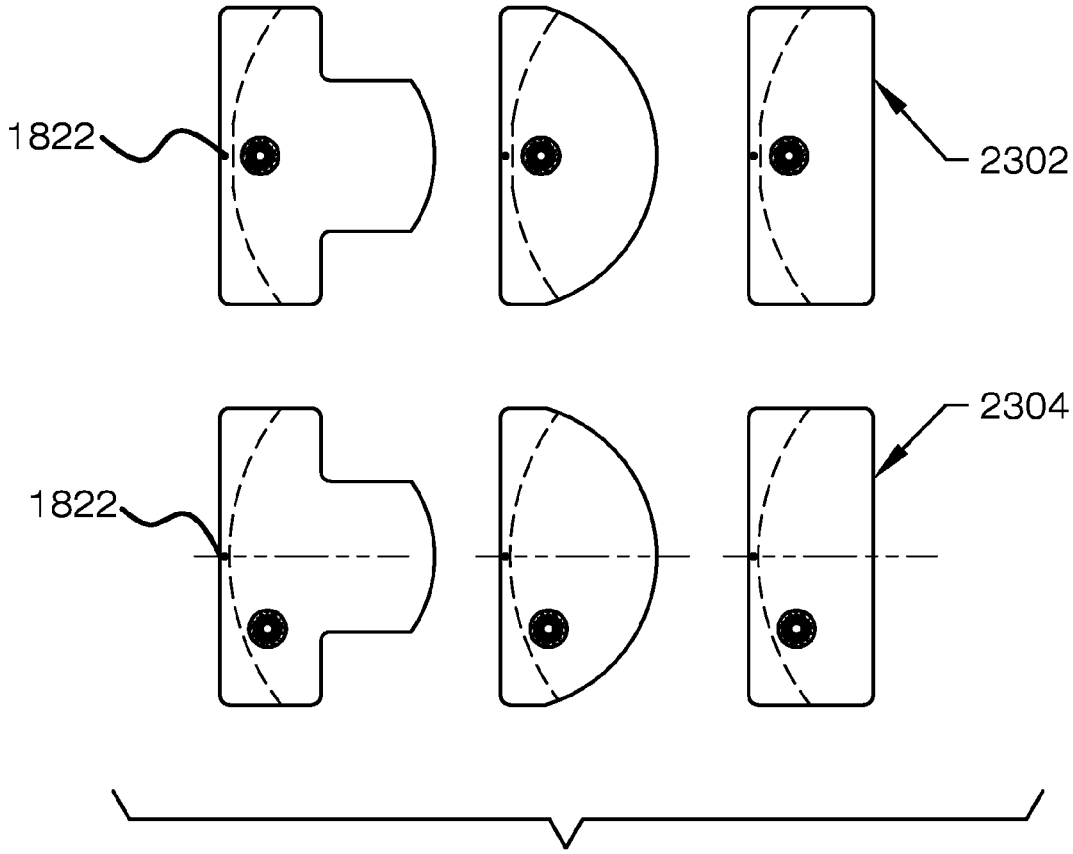
FIG. 23 illustrates head shapes with centrally inserted putter shafts (set 2302) and head shapes with off-center inserted putter shafts (set 2304) as variations for putter 1800.

FIG. 23 illustrates head shapes with centrally inserted putter shafts (set 2302) and head shapes with off-center inserted putter shafts (set 2304) as variations for putter 1800.

The putter may be a practice putter that may help a golfer hole more putts. The putter may be produced similarly to a conventional putter. The club head and shaft may be cast or machined from carbon steel, tungsten, titanium, or a similar metal. The putter may differ from other putters in that the face of the putter head may be machined in such a manner that it may exaggerate the results of the putt. A perfectly straight putt may travel as normal. However, if the putt may be slightly off to the left, then the ball may roll much further to the left than it usually may roll. Likewise, if the putt may be too far to the right, then the ball may roll far in that direction. This exaggerated motion may enable the user readily to tell in which way the user may be mishandling the putter and may allow the user to adjust his putting swing accordingly. Thus, with practice, the user may adjust the putt of the user to go straight more often.

The putter may fulfill a need for a golf practice putter that may help a golfer putt more successfully. Appealing features of the putter may be its ability to help a golfer hole more putts. With a typical golf putter, the golfer often may not be able to tell exactly which way the aim may be off. The putter may provide exaggerated results so that there may be no mistake in telling where the golfer may be making his mistake. The golfer may then be able to adjust the golfer's practice accordingly. As a result, the golfer's accuracy may improve, and the golfer may hole more putts. This may help the golfer shoot lower scores and receive more enjoyment from each round of golf.

The putter may cause the golf ball to roll in an intended straight direction rather than undesirably cause the putted ball to roll either to the left or to the right. The left or right roll of the ball now may be pronounced enough for the player to determine which way the player is mishandling the putter and thus the player may be able to make corrective adjustments to the player's putting swings. This may lead to the golfer shooting lower scores and receiving more enjoyment from each round of golf.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A golf club putter to improve a golf putt swing through both negative and positive putting training feedback, the golf club putter comprising:

a shaft;

a shaft insert attached to the shaft; and a head attached to the shaft insert, where the head includes a shell attached to a clubface and a false front attached to the shell to extend away from the shell and overhang the clubface, where the clubface includes a target as a vertical flat striking face, where a centerline passes perpendicularly through a midpoint of the target, where the clubface further includes a first off-target that is curved to provide negative putting training feedback and a second off-target that is curved to provide negative putting training feedback, where the first off-target and the second off-target are symmetrical about the target, and where the false front includes a lead false front edge having a lead false front edge profile that is straight and perpendicular to the centerline, where the lead false front edge profile is positioned at an overhang distance from the target as measured along the centerline, where the overhang distance is not greater than ¼ inch and not less than 1/32 inch.

2. The golf club putter of claim 1, where the target includes a target width that is greater than ⅜ inch and where perimeters of the first off-target and the second off-target follow paths that are away from a plane of the target.

3. The golf club putter of claim 2, where the target is a rectangular shaped surface orientated on the clubface to be centered on the shaft insert so that the target is perpendicular to a centerline passing through the target and the shaft insert.

4. The golf club putter of claim 2, where an upper surface of the head includes a point inlaid along the centerline.

5. The golf club putter of claim 2, where the first off-target and the second off-target are formed from a single curve interrupted and made discontinuous by the target.

6. The golf club putter of claim 5, where the first off-target and the second off-target extend equidistance horizontally away from the centerline.

7. The golf club putter of claim 2, where a curvature of the first off-target and the second off-target are part of a circle having a circle center on the centerline, where the circle center is positioned at a shell rear distance, where the shell rear distance is positioned remote from the head and a shell rear of the shell, and where the shell rear distance is measured along the centerline between the shell rear and the circle center.

8. The golf club putter of claim 7, where the curvature of the first off-target and the second off-target are defined by an off-target radius and where a ratio of the off-target radius to the shell rear distance approximately is 3:1.

9. The golf club putter of claim 1, where the target includes a target height and the target width and where a ratio of the target height to the target width is 4:1.

10. The golf club putter of claim 9, where the centerline passes through the shaft insert.

11. The golf club putter of claim 9, where the centerline does not pass through the shaft insert.

* * * * *